US007265287B2

(12) United States Patent
Shimada

(10) Patent No.: US 7,265,287 B2
(45) Date of Patent: Sep. 4, 2007

(54) SUPPORT DEVICE FOR PERCUSSION INSTRUMENTS

(75) Inventor: Masahiro Shimada, Seto (JP)

(73) Assignee: Hoshino Gakki Mfg. Co., Ltd. (JP)

( * ) Notice: Subject to any disclaimer, the term of this patent is extended or adjusted under 35 U.S.C. 154(b) by 0 days.

(21) Appl. No.: 11/087,449

(22) Filed: Mar. 23, 2005

(65) Prior Publication Data

US 2006/0081114 A1 Apr. 20, 2006

(30) Foreign Application Priority Data

Oct. 20, 2004 (JP) ..... 2004-305329
Nov. 30, 2004 (JP) ..... 2004-347726

(51) Int. Cl.
*G10D 13/02* (2006.01)

(52) U.S. Cl. ..... 84/421; 84/104

(58) Field of Classification Search ..... 84/421, 84/411 P, 327, 104, 453
See application file for complete search history.

(56) References Cited

U.S. PATENT DOCUMENTS 3,774,823 A * 11/1973 Hoellerich ..... 84/421
6,172,290 B1 1/2001 May ..... 84/421
6,403,869 B2 * 6/2002 May ..... 84/421
6,765,140 B2 * 7/2004 Crouch ..... 84/421
2005/0274854 A1 * 12/2005 May ..... 248/171

OTHER PUBLICATIONS

Encyclopedia at <www.Reference.com>; Lexico Publishing Group, LLC, 2005. Wikipedia, 2001-2005.*

* cited by examiner

*Primary Examiner*—Lincoln Donovan
*Assistant Examiner*—Jianchun Qin
(74) *Attorney, Agent, or Firm*—Ostrolenk, Faber, Gerb & Soffen, LLP

(57) ABSTRACT

In a support device for a set of marching tenor drums arrayed in an arc shape of at least four drums, the device being held on the body of a player, two or three consecutive drums of the array, form at least one group. The device includes a holding mechanism for keeping the positions of the drums in each group constant relative to drums within the same group, and a turnable linking mechanism for linking the group and drums adjoining the group to be turnable relative to each other.

19 Claims, 14 Drawing Sheets

SUPPORT DEVICE FOR PERCUSSION INSTRUMENTS

BACKGROUND OF THE INVENTION

The present invention relates to a support device for percussion instruments, and more particularly to a support device for marching tenor drums.

A set of marching tenor drums comprises four to six drums linked in an arc shape, and the player plays carrying these drums on his body while walking. This set of drums should keep its arc shape against the vibration occurring from the player's walking and beating, and yet the position and posture of each individual drum should be controlled as required.

FIG. 16 shows such a drum set 121. The drum set 121 comprises four larger-diameter drums 122 through 125 arranged in an arc shape and a small-diameter drum 126 surrounded by these larger-diameter drums 122 through 125. A support device 131 supporting the drum set 121 comprises a frame 132 worn by the player and three hinge portions 133, 134 and 135 each turnably linking adjoining ones of the larger-diameter drums 122 through 125.

As shown in FIG. 17, the frame 132 comprises a pair of right and left arms 136 extending in the lengthwise direction and support pieces 137 each fitted to one end of the two arms 136 via an L-shaped holder 139. A substantially cylindrical holding portion 138 forbearing a J-shaped rod of a drum carrier (not shown) protrudes from the holder 139. The holder 139 is fixed to the support piece 137 and is slidable on the arm 136. Each support piece 137 has an elongated hole 142, and the elongated holes 142 allow a bracket 141 turnably supporting the larger-diameter drums 122 and 125, situated at the two ends of the arc-shaped array, to slide.

When the player wears the supporting device 131, the larger-diameter drums 122 through 125 and the small-diameter drum 126 are positioned in front of him.

In the support device 131, when the brackets 141 are slid back and forth along the elongated holes 142, the positions of the larger-diameter drums 122 through 125 can be adjusted back and forth. When the holders 139 are slid laterally relative to the arms 136, the positions of the larger-diameter drums 122 through 125 can be adjusted laterally via the brackets 141.

In the support device described above, the larger-diameter drums 122 through 125 are turnably linked by the hinge portions 133, 134 and 135. For this reason, if the drums are slid forward or backward to adjust their positions in the back-and-forth direction, the larger-diameter drums 122 through 125 will irregularly moved. Also when adjusting the positions of the drums laterally, the sliding of the holders 139 will cause the larger-diameter drums 122 through 125 to move irregularly.

The aforementioned undesirable motions of the drums will be described below in more detail. Suppose that the larger-diameter drums 123 and 124 in the center area are in their desired positions in the back-and-forth direction and need to be controlled only laterally. If the holders 139 are slid here on the arms 136, the larger-diameter drums 123 and 124 will move indeterminately to vary their positions in the back-and-forth direction.

Further, if the holders 139 are slid on the arms 136 when adjusting the positions of the larger-diameter drums 123 and 124 laterally, since one end of a rod 200 supported by the holding portions 138 of the holders 139 is fitted to the carrier, the distance between the player and the frame 132 will vary, eventually changing the positional relationship between the player and each drum. Whereas the positions of the drums including the small-diameter drum 126 in the back-and-forth direction may be sometimes adjusted by sliding the holder 139, the positional relationships of the drums will also vary in this case because sliding the holders 139 would vary the length of the frame 132.

In this way, when the position of each of the larger-diameter drums 122 and 125 at both ends is to be adjusted in the lateral direction or that of the whole drum set is to be adjusted in the back-and-forth direction, there is a problem that adjustment is difficult because sliding destabilizes the motions of the individual drums (especially the two larger-diameter drums 123 and 124 at the center).

Further, when the holders 139 are slid in such a positional adjustment, the force working in the lateral direction due to that sliding acts as a torque on the hinge portions 133 through 135. When a torque works on the hinge portions 133 through 135, they turn in unpredictable manners. The support device 131, having many such hinge portions, lacks in stability.

Moreover, the configuration of the support device is complex, involves many members resulting in a heavy total weight for the device, imposing a heavy load on the player.

SUMMARY OF THE INVENTION

An object of the present invention is to provide a support device for percussion instruments which allows easy positional adjustment of the individual drums while stably supporting the drums.

In order to achieve the object stated above, the invention provides a support device for supporting a set of marching tenor drums consecutively arrayed in an arc shape and including at least four drums, the device being held on the body of a player wherein two or three consecutive drums of the array, forms at least one group, and the device comprises a holding mechanism for keeping the positions of the drums in each group constant relative to drums within the same group and a turnable linking mechanism for linking the group and drums adjoining the group so as to be turnable relative to each other.

DETAILED DESCRIPTION OF THE PREFERRED EMBODIMENTS

A preferred embodiment of the present invention will be described below with reference to FIG. 1 through FIG. 12.

Figure 1:
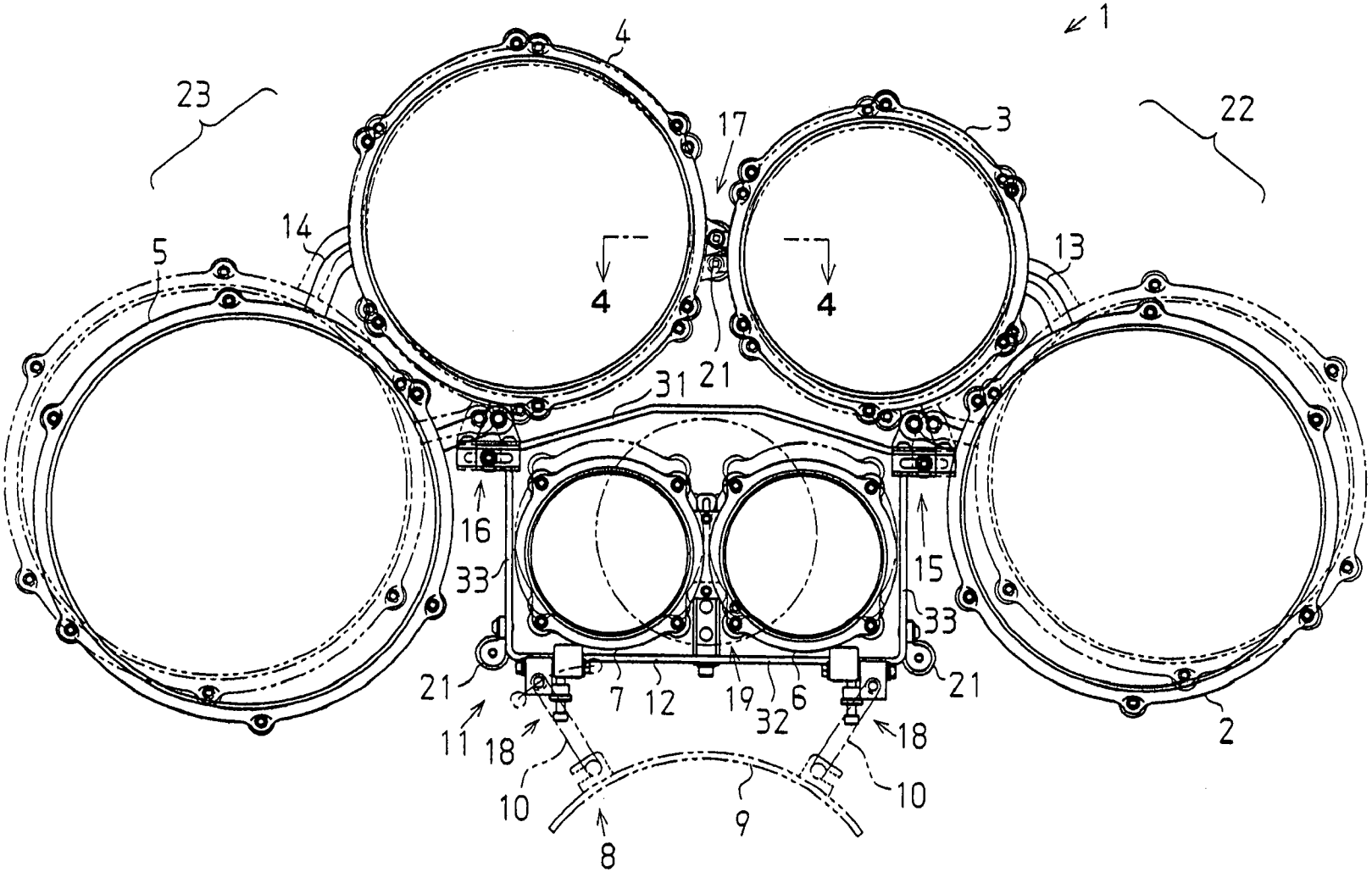
FIG. 1 is a schematic plan showing how a support device for drums according to a preferred embodiment of the present invention is used.

As shown in FIG. 1, a drum set 1 comprises four larger-diameter drums 2, 3, 4 and 5 and two smaller-diameter drums 6 and 7. The larger-diameter drums 2 through 5, arrayed along a semicircle, surround the two smaller-diameter drums 6 and 7.

A support device 11 for the drum set 1 comprises a substantially rectangular frame 12 surrounding the smaller-diameter drums 6 and 7, a first fixing mechanism 13 surrounding the frame 12, a second fixing mechanism 14, a first adjusting mechanism 15, a second adjusting mechanism 16, a linking mechanism 17, holders 18, a smaller-diameter drum fitting portion 19 and legs 21. The first fixing mechanism 13 links a pair of larger-diameter drums 2 and 3 adjoining each other on the right side at the barrel 37 forming the body of each drum 2 and 3 (see FIG. 3) to be incapable of relative movement. The second fixing mechanism 14 links a pair of larger-diameter drums 4 and 5 adjoining each other on the left side at the barrel forming the body of each drum 4 and 5 to be incapable of relative movement. The right-side larger-diameter drums 2 and 3 form a first drum pair 22, and the left-side drums 4 and 5 form a second drum pair 23.

The first adjusting mechanism 15 is positioned at the front right of the outside of the frame 12 and turnably links the first drum pair 22 to the frame 12. The second adjusting mechanism 16 is positioned at the front left of the outside of the frame 12 and turnably links the second drum pair 23 to the frame 12. The linking mechanism 17, disposed between the larger-diameter drums 3 and 4, turnably links the first and second drum pairs 22 and 23. In the rear part of the frame 12, a cylindrical sleeve 88 (see FIG. 8C) is formed on each of the two holders 18. A J-rod 10, one end of which is turnably fixed to the shank pad 9 of a carrier 8, is inserted from underneath into each of the sleeves 88, and the carrier 8 and the supporting device 11 are thereby linked with each other.

A fitting member 19, which supports the smaller-diameter drums substantially at the center of the rear part of the frame 12, protrudes forward within the frame 12.

The legs 21 are fitted to the two ends of the rear part of the frame 12 and the linking mechanism 17. Since the larger-diameter drums 2 and 3 are fixed to each other, the first drum pair 22 moves integrally when the positions of the drums 2 through 5 are adjusted. The second drum pair 23 also moves integrally.

The supporting device 11 will next be described. The frame 12 comprises first and second longer sides 31 and 32, respectively positioned in front and in back and extending in the lengthwise direction, and a pair of shorter sides 33 linking these first and second longer sides 31 and 32 at both ends.

Figure 2:
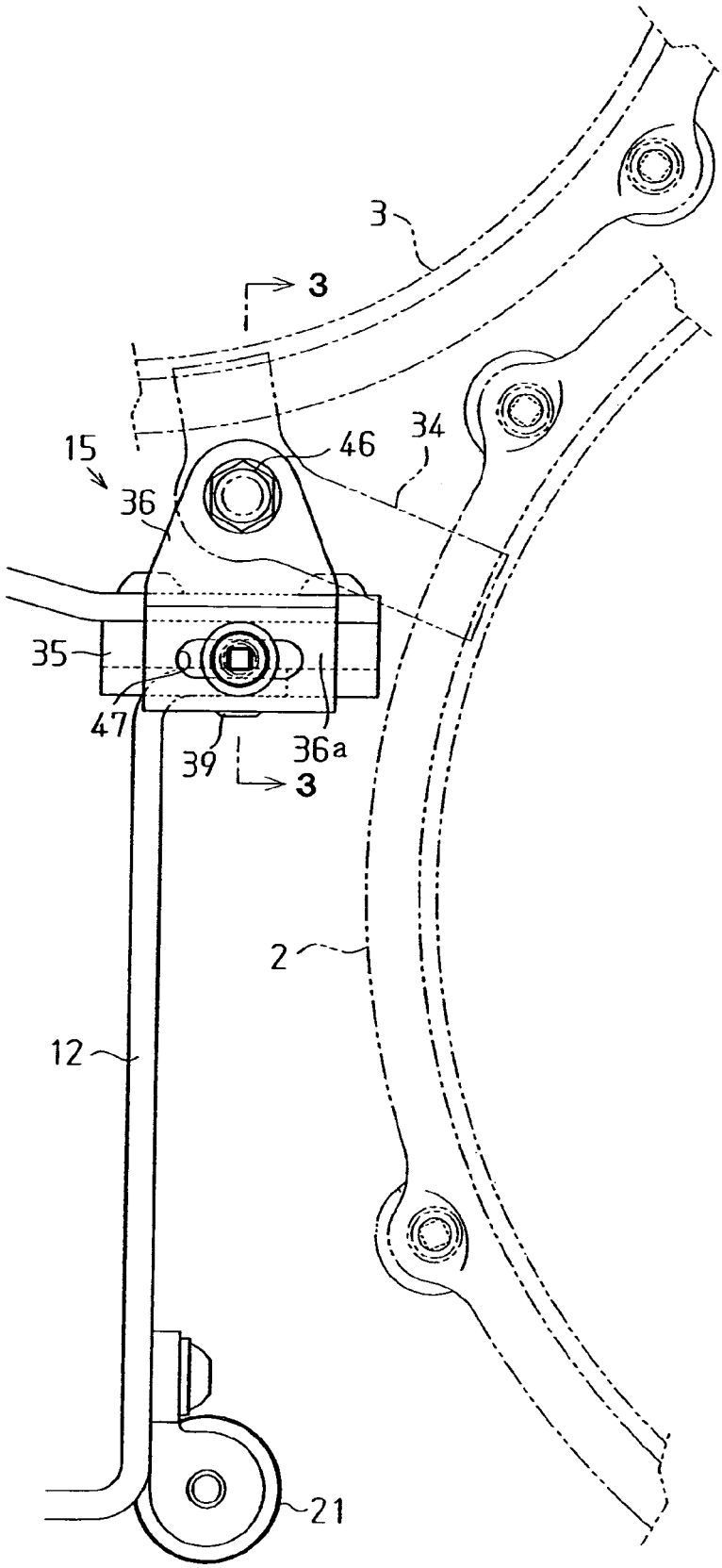
FIG. 2 is a plan view showing the configuration of a first adjusting mechanism 15 of FIG. 1.
Figure 3:
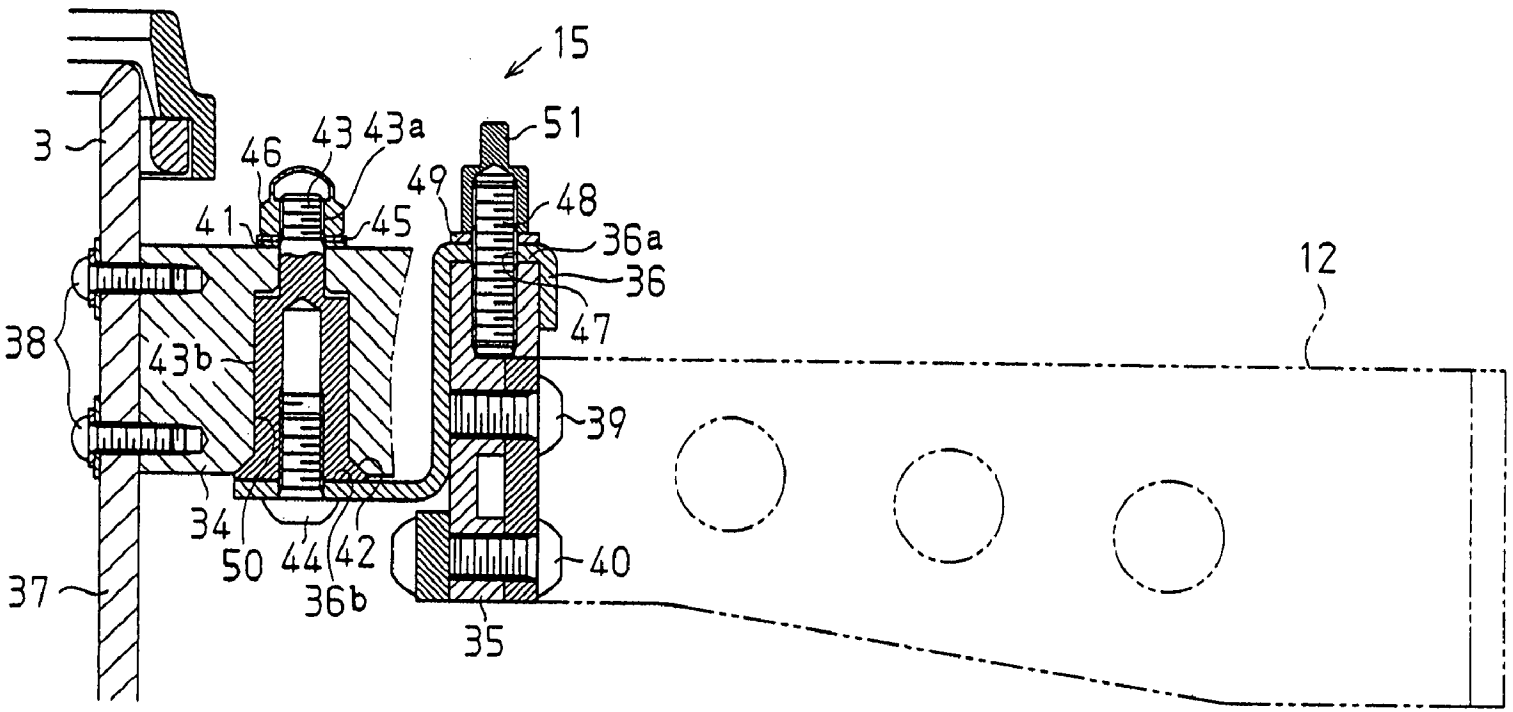
FIG. 3 is a section taken along line 3-3 in FIG. 2.

As shown in FIG. 2, the first adjusting mechanism 15 comprises elbow pieces 34 for fixing the larger-diameter drums 2 and 3, a base 35 fixed to the frame 12, and a bracket 36 capable of sliding on the base 35. As shown in FIG. 3, the elbow pieces 34 are fitted to the barrels 37 of the larger-diameter drums 2 and 3 from the insides thereof with two screws 38 each. The base 35 is fitted to the frame 12 with two screws 39 and 40. One U-shaped end of the bracket 36 is so fitted as to cover the upper part of the base 35, while the other end is fitted with a screw 44 to a shaft 43 turnably engaged with a hole 50 of the elbow piece 34. The shaft 43 has a tapered portion 42 narrowing upward to absorb any fitting error between the shaft 43 and the hole 50. A nut 46 fitted with a spring seat 41 and a washer 45 therebetween is screwed onto the upper end of the shaft 43 protruding from the upper part of the elbow piece 34, and the first drum pair 22 is thereby turnably supported around the shaft 43 with appropriate friction.

As shown in FIG. 2, an elongated hole 47 is formed in the top face 36*a* of the bracket 36. An engaging shaft 48 pressed in from above the top face 36*a* of the bracket 36 is adhered at the bottom end thereof to the base 35. A nut 51 is screwed, with a washer 49 therebetween, onto the outer circumference of the engaging shaft 48 protruding from the top face 36*a* of the bracket 36.

When the nut 51 is loosened, the bracket 36 can slide on the base 35 within the elongated hole 47. The bracket 36 can move only along the elongated hole 47, but its motion in any other direction is restricted. Therefore, the first adjusting mechanism 15 has a stable configuration in the absence of being irregularly moved by an external force.

While the foregoing description referred to the first adjusting mechanism 15, the second adjusting mechanism 16 is similar in configuration, and accordingly its detailed description will be dispensed with.

Figure 4:
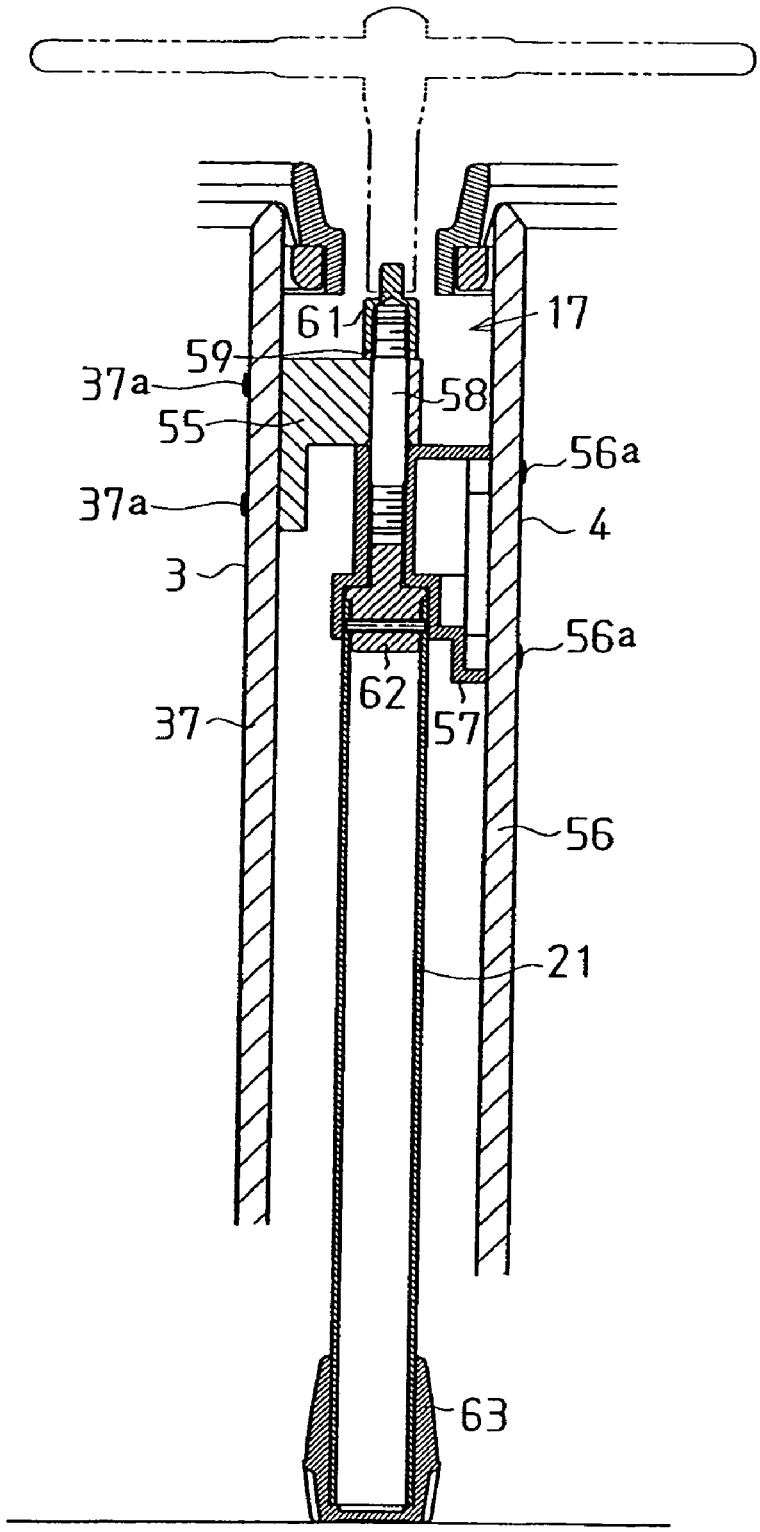
FIG. 4, shows the configuration of a linking mechanism 17, taken along section along line 4-4 in FIG. 1.

FIG. 4 shows the configuration of the linking mechanism 17. A first connecting member 55 is fixed to the barrel 37 of the drum 3. A second connecting member 57 is fixed to the barrel 56 of the drum 4. The first connecting member 55 is arranged over the second connecting member 57, and a pin 58 is snapped into a through hole penetrating both members 55 and 57. The pin 58 is screwed from underneath into the second connecting member 57 and protruded upward through the first connecting member 55. A square-headed nut 61 is screwed onto the pin 58 with a washer 59 therebetween to link the first connecting member 55 and the second connecting member 57.

When the nut 61 is loosened, the first connecting member 55 is enabled to turn or rotate about the shaft 58.

Also, one of the legs 21 having a screw 62 at the upper end is screwed from underneath into the second connecting member 57. The bottom end of the leg 21 is fitted with a rubber cap 63.

Figure 5:
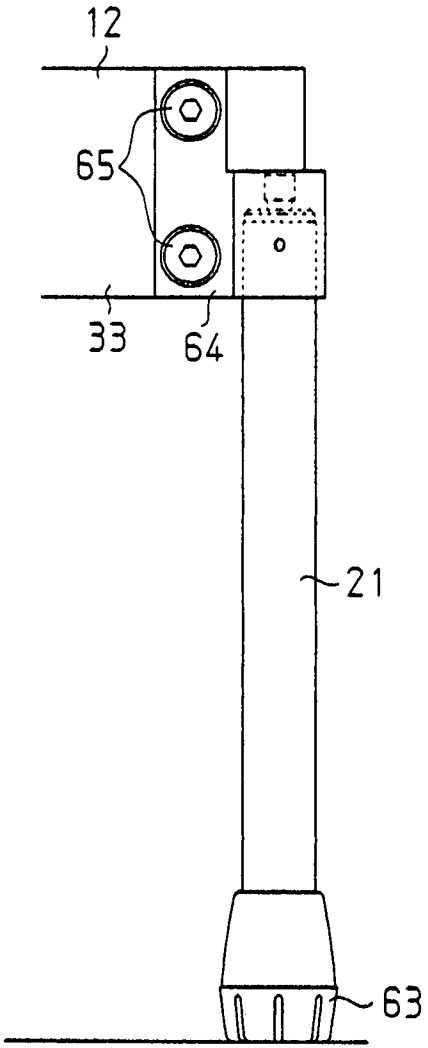
FIG. 5 is a left side profile view showing the fitting portion of a leg 21 disposed at the left end of the second longer side of a frame in FIG. 1.
Figure 6:
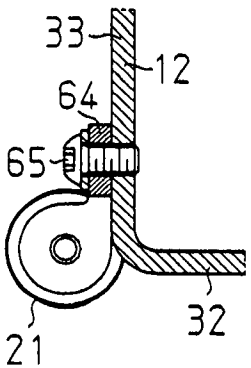
FIG. 6 is a plan view showing the fitting portion of the leg 21 disposed at the left end of the second longer side of a frame in FIG. 1.

In addition, legs 21 are disposed at both ends of the second longer side 32 of the frame 12. FIG. 5 is a left side profile view showing the fitting portion of a leg 21 disposed at the left end of the second longer side 32, and FIG. 6 is a plan view thereof. As shown in FIG. 5 and FIG. 6, a leg 21 is fitted to a fixed member 64 fixed with a screw 65 to a side face of the frame 12.

The first fixing mechanism 13, linking the drums 2 and 3, has an arm shape having a curved part, and is fitted to the barrel 37 of the larger-diameter drums 2 and 3 with two screws (not shown) inserted from inside the barrel 37 of each drum 2 and 3. The second fixing mechanism 14, linking the drums 4 and 5, has an arm shape having a curved part, and is fitted to the barrels 37 of the larger-diameter drums 2 and 3 with two screws (not shown) inserted from inside the barrel of each drum 2 and 3. Since these configurations are substantially the same as the mode of fitting the elbow piece 34 (see FIG. 3) in the first adjusting mechanism 15, their detailed description will be dispensed with.

Figure 7:
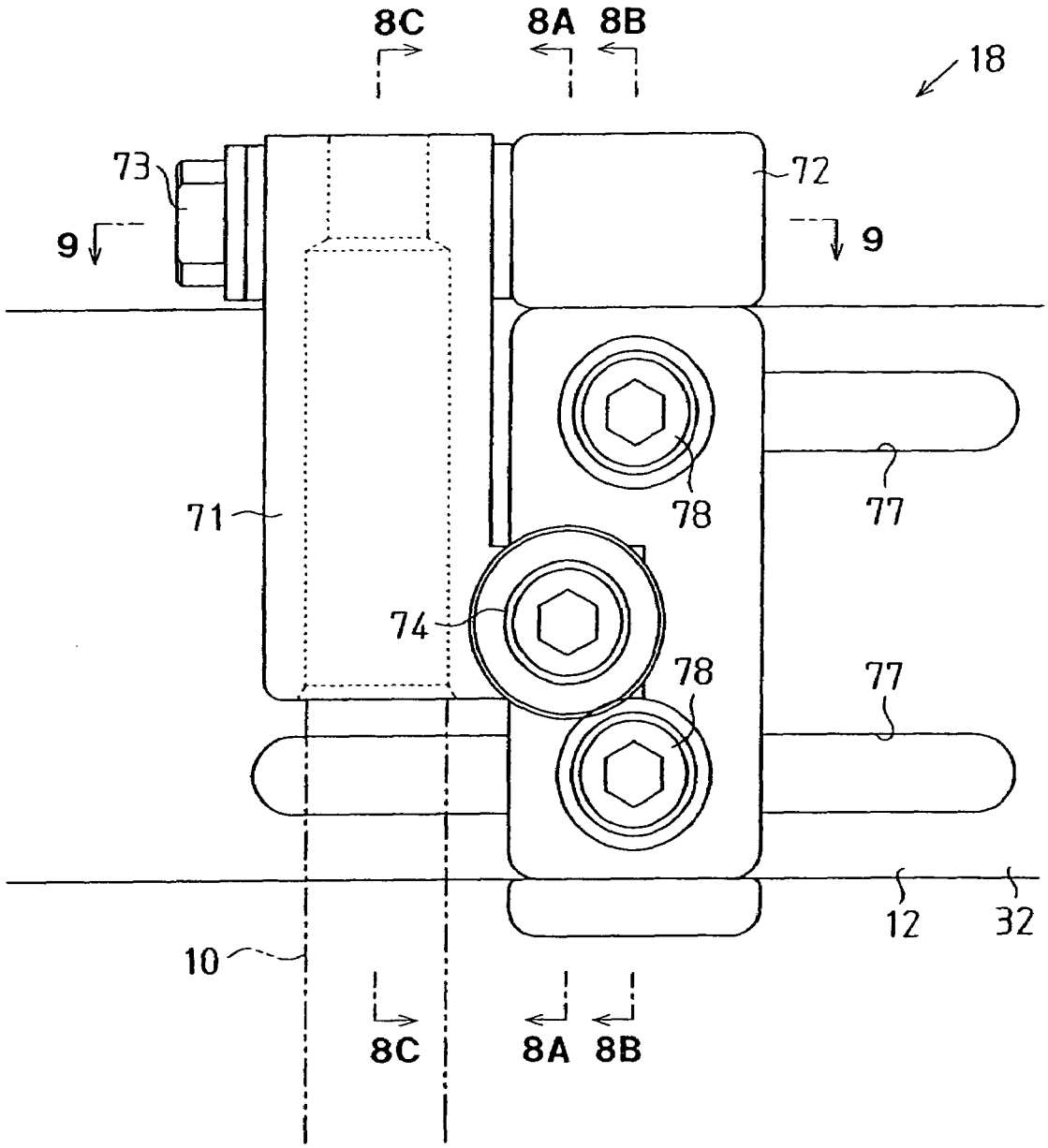
FIG. 7 shows a front view of the structure of a holder 18 of FIG. 1.
Figure 8A:
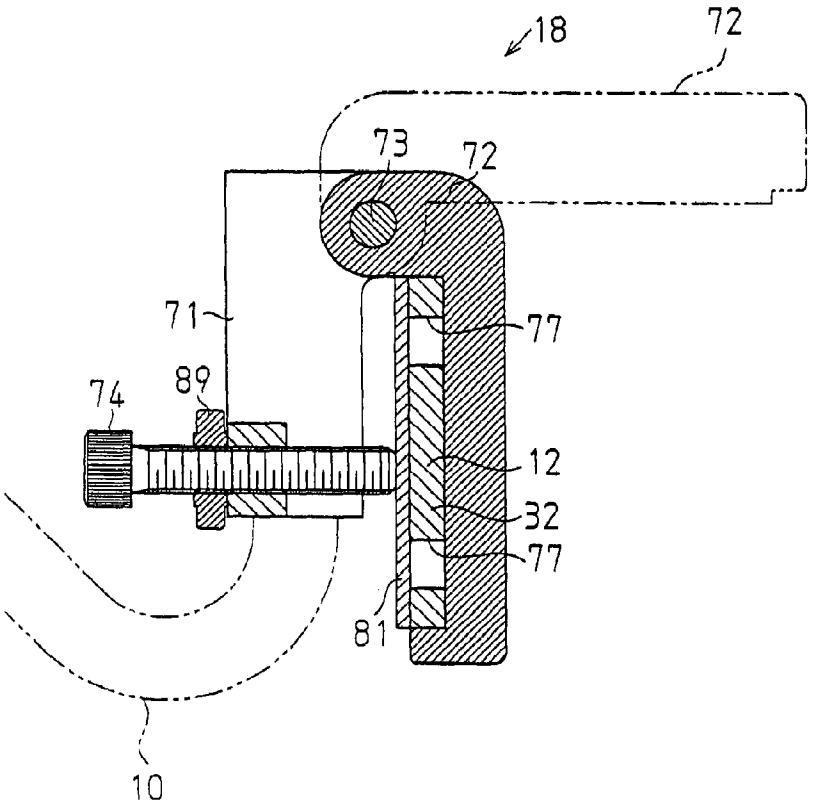
FIG. 8A shows a section taken along line 8A-8A in FIG. 7.
Figure 9:
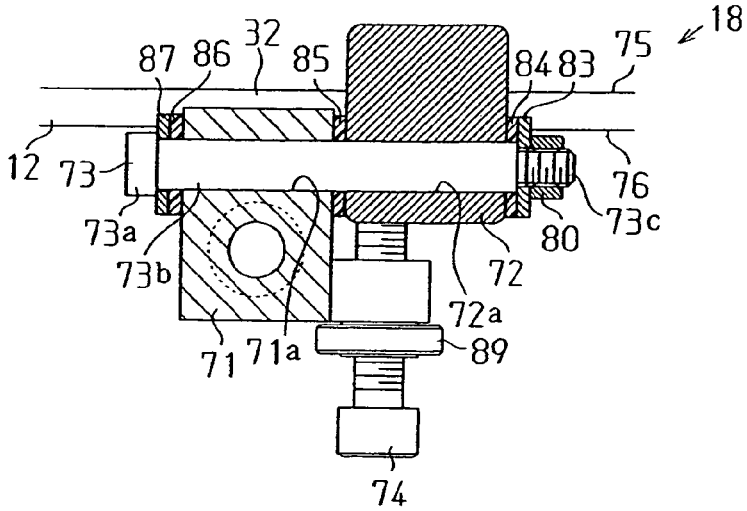
FIG. 9 shows a section taken along line 9-9 in FIG. 7.

The structure of the two holders 18 disposed on the second longer side 32 of the frame 12 will be described next. As shown in FIG. 7 and FIG. 9, each of the holders 18 comprises a cylindrical portion 71 into which the J-rod 10 (see FIG. 8A) of the carrier 8 is inserted, a connecting portion 72, a shaft 73 linking this connecting portion 72 and cylindrical portion 71 to be turnable relative to each other, and a bolt 74.

Figure 8B:
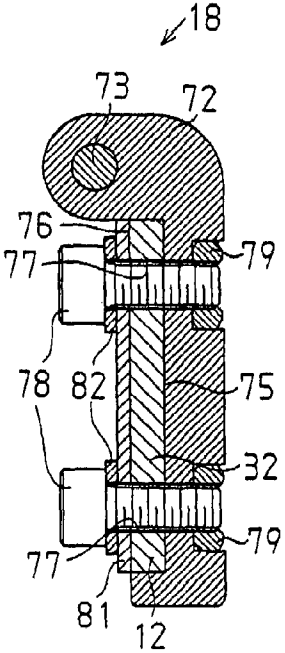
FIG. 8B shows a section taken along line 8B-8B in FIG. 7.

As shown in FIG. 8B, the connecting portion 72 is fitted to the frame 12 by screwing a nut 79 onto the tip of each of the bolts 78 penetrating two elongated holes 77, upper and lower, formed in the frame 12 from the surface 76 (the surface nearest toward the player) of the second longer side of the frame 12. A plate 81 for connection use and a washer 82 are disposed between the surface 76 of the second longer side 32 and the bolts 78. When the two bolts 78 are loosened, the connecting portion 72 can slide laterally within the ranges of the elongated holes 77.

As shown in FIG. 9, the rotation shaft 73 is inserted from outside the second longer side 32 (from the left side in FIG. 9) into the cylindrical portion 71 and the upper part of the connecting portion 72. The cylindrical portion 71 is positioned on the surface 76 side of the second longer side 32. On the outer circumference of the rotation shaft 73, a plurality of washers 83, 84, 85, 86 and 87 are externally fitted, and the rotation shaft 73 and the connecting portion 72 can turn relative to the cylindrical portion 71 when in use. The washers 84, 85 and 86, which come into contact with the connecting portion 72 and the cylindrical portion 71 are made of resin, and all these washers (83 through 87) are fastened with a nut 80 so that the connecting portion 72 may not be moved by its own weight and can be easily adjusted to any desired angle. This arrangement, when the player puts on the carrier 8 and fits the drums, prevents the connecting portion 72 from being turned inadvertently and thereby facilitates the fitting of the drums.

Figure 8C:
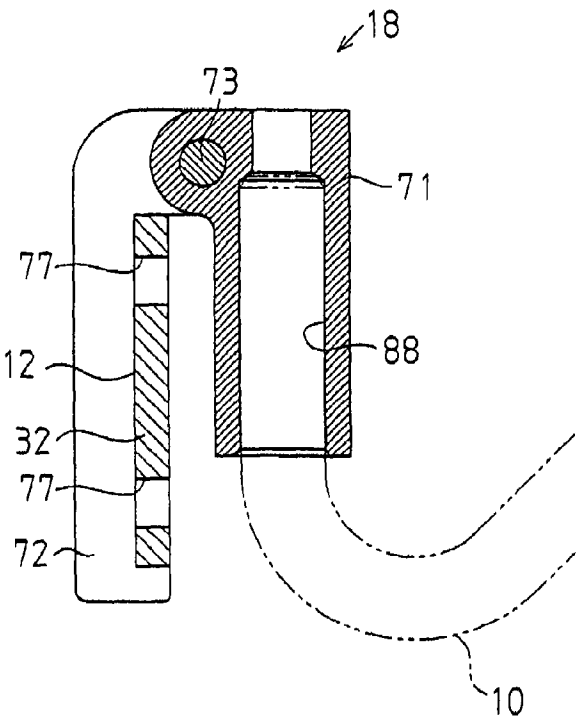
FIG. 8C shows a section taken along line 8C-8C in FIG. 7.

As shown in FIG. 8C, a hole 88 is formed in the cylindrical portion 71 to allow the J-rod 10 of the carrier 8 to be inserted from underneath. The carrier 8 and the supporting device 11 are linked to each other by the J-rod 10 inserted into the hole 88. When the player is standing by during a performance session, if he lifts the frame 12 as indicated by the two-dot chain lines in FIG. 8A, the rotation shaft 73 and the connecting portion 72 will turn by about 90 degrees to make the arrayed faces of the drums substantially parallel to the player's body. In this way, the drums can be kept out of the way while the player is standing by and the load on his shoulders can be reduced at the same time.

Also, as shown in FIG. 8A, the lower part of the cylindrical portion 71 is penetrated by the bolt 74 with a lock nut 89 therebetween. The tip of the penetrating bolt 74 is in contact with the plate 81. Therefore, as the extent of protrusion of the tip of this bolt 74 is adjusted to thrust the frame 12 up or down, the angle of the frame 12, i.e., of the drum set 1, which is thereby finely adjusted.

Figure 10:
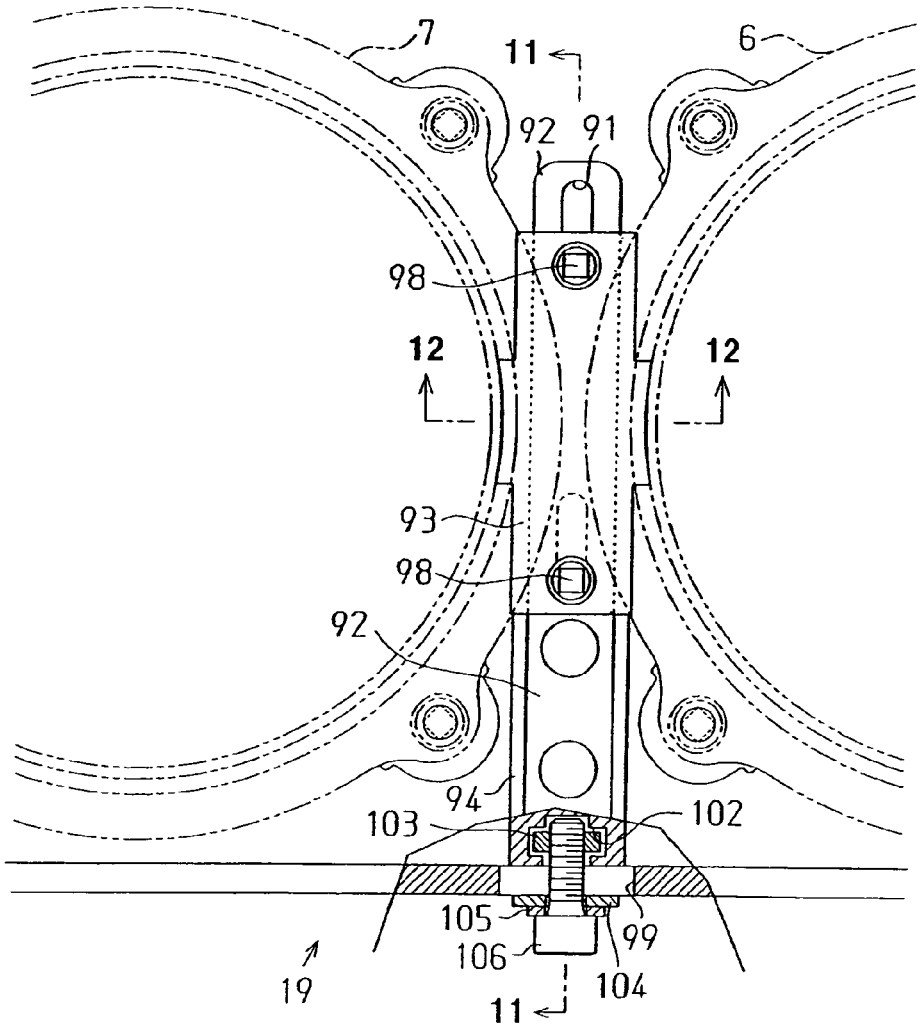
FIG. 10 is a plan view showing part of a fitting mechanism in a sectional view.
Figure 11:
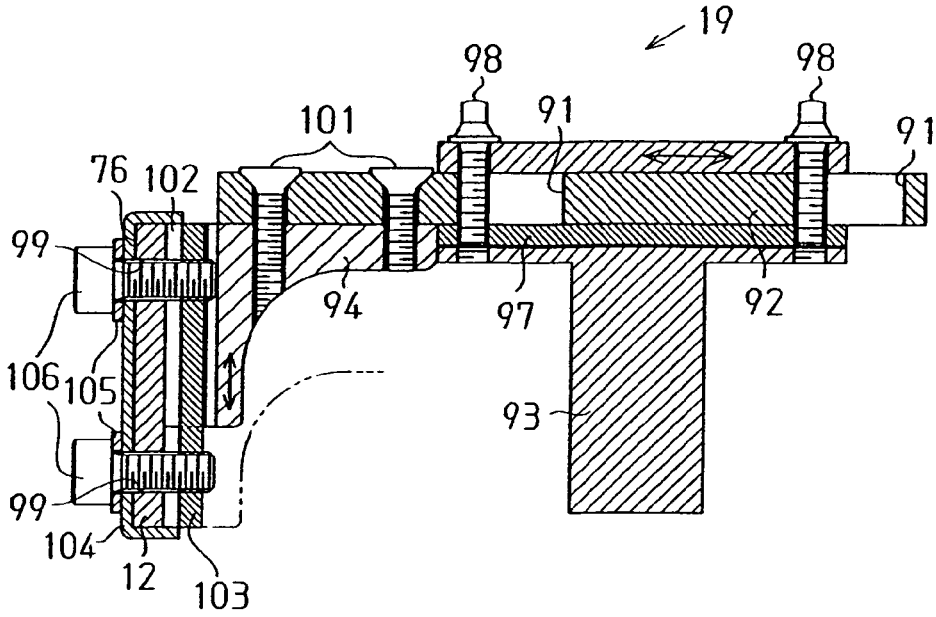
FIG. 11 shows a section taken along line 11-11 in FIG. 10.
Figure 12:
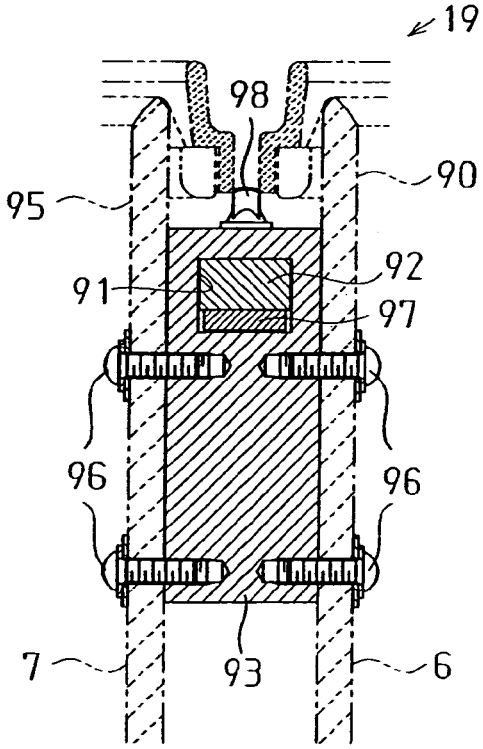
FIG. 12 shows a section taken along line 12-12 in FIG. 10.

The fitting mechanism 19 for the smaller-diameter drums 6 and 7 will be described next. As shown in FIG. 10 through FIG. 12, a base 92 is fitted to a connector 94 orthogonally crossing the second longer side 32 of the frame 12 from the longer side 32 and into the frame 12. The drums 6 and 7 are fitted to a movable piece 93 with screws 96 inserted from inside the barrels 90 and 95, and the drums 6 and 7 are thereby linked to each other.

Further, the base 92 and an auxiliary plate 97 extend into the connector 94. Two screws 98 inserted from above a connector 93 press through a slit 91 in the base 92. The lower end of each of the screws 98 is screwed onto the auxiliary plate 97, and the screws 98, the connector 93 and the auxiliary plate 97 slide back and forth along the slit 91 in the base 92.

Behind the base 92, the connector 94 is fitted by screws 101 inserted from above. A vertical plate 103 arranged behind this connector 94 (the left side in FIG. 11) slides within a groove 102 in the connector 94. Screws 106 inserted, with washers 105 therebetween, from behind a cover 104 shielding the surface 76 of the frame 12, pass through slits 99 formed in the frame 12 and engage with the vertical plate 103.

When the screws 106 are tightened, the connector 94 is fixed, and held between the frame 12 and the vertical plate 103. When the screws 106 are loosened, the force of holding the connector 94 between the frame 12 and the vertical plate 103 decreases, and the connector 94 is enabled to be able to slide up and down within the range of the width of the cover 104 in the perpendicular direction.

FIG. 11 shows the drums 6 and 7 in their respective positions of use. Thus, the drums 6 and 7 are in their highest positions, the upper end of the connector 94 is in contact with the rear side of the upper end of the cover 104, and the heights of the respective heads of the smaller-diameter drums 6 and 7 and of the larger-diameter drums 2 through 5 are set to be equal. In this way, the upper end of the cover 104 functions as a stopper to indicate the prescribed height positions of the smaller-diameter drums 6 and 7.

In the state indicated by the two-dot chain line in FIG. 11, the connector 94 is in its lowest position. The lower end of the connector 94 is in contact with the rear side of the lower end of the cover 104. In this way, the lower end of the cover 104 functions as a stopper to prevent the connector 94 from falling down.

Figure 14:
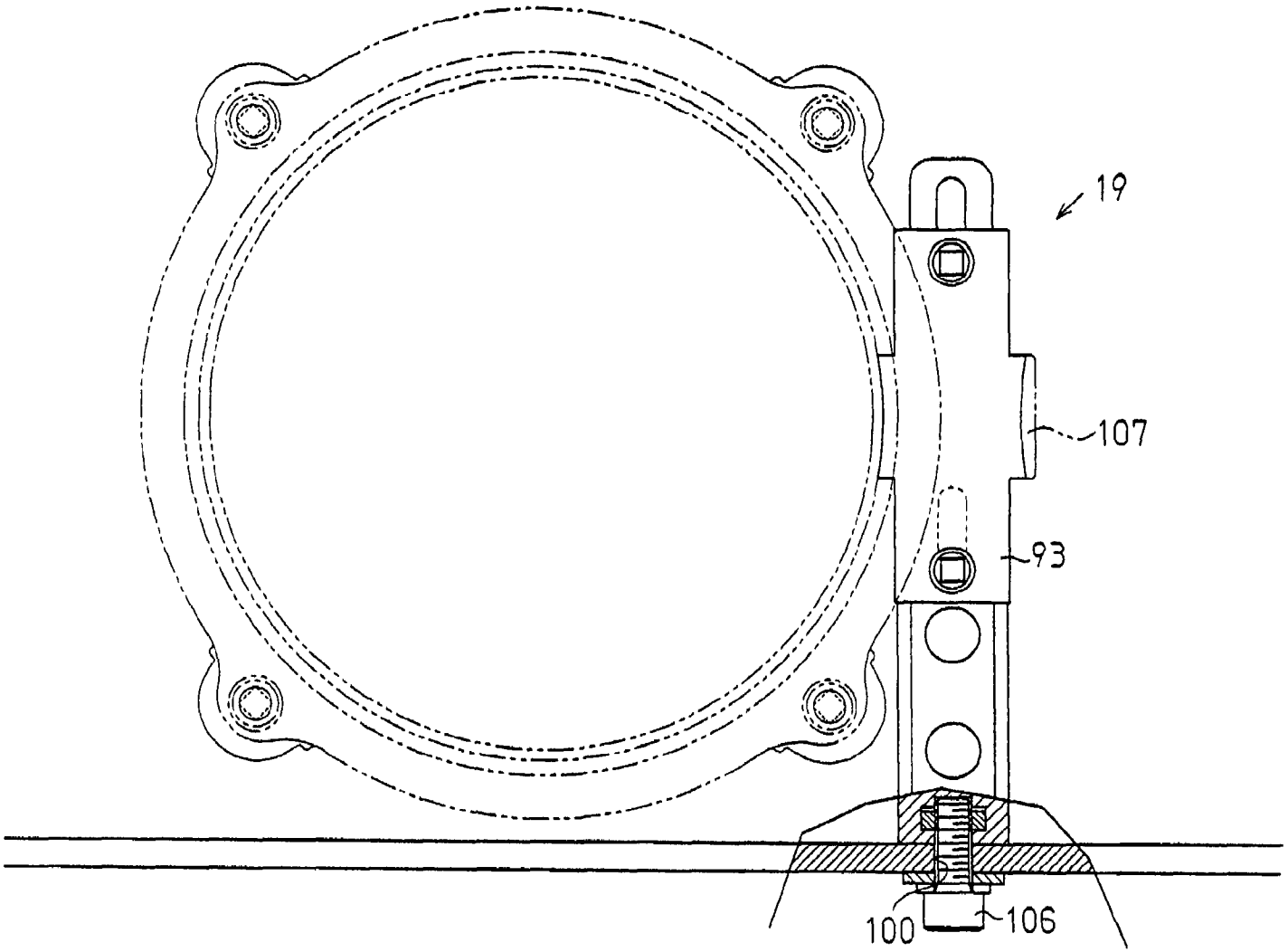
FIG. 14 is a plan showing the arrangement of a small-diameter drum in the other embodiment of the invention.

By the same principle as described above, the connector 94 is enabled to slide within the range of the width in the horizontal direction of the slits 99 formed in the frame 12 by loosening the screws 106. Therefore, the positions of the smaller-diameter drums 6 and 7 in the right-and-left direction can also be adjusted. FIG. 14 shows a case or alternate embodiment in which the smaller-diameter drums 6 and 7 need not be adjusted in the right-and-left direction, and a round hole 100 is used in place of the slits 99.

Next, the method of adjusting the positions of the drums 2 through 7 will be roughly described. A player holding the carrier 8 with the drums 2 through 7 fitted to the supporting device 11 first adjusts the back-and-forth positions of all the drums 2 through 7. Once the back-and-forth positions of the drums 2 through 7 are set, the player next adjusts the lateral positions of the larger-diameter drums 2 and 5 at both ends. Then, he adjusts the back-and-forth and up-and-down positions of the smaller-diameter drums 6 and 7 within the frame 12, and finally adjusts the overall angle (the angle formed by the upright player's body and the arrayed faces of the drums).

The method of adjusting the position in each aspect of the drums will now be described in detail. Before positional adjustment of the drums, the nuts 46 in the first adjusting mechanism 15 and the second adjusting mechanism 16 and the nut 61 in the linking mechanism 17 are loosened to some extent to allow the larger-diameter drums 2 through 5 to turn. For turning these nuts, a known tuning key, represented by the two-dot chain lines in FIG. 4, is used.

The positional adjustment in the back-and-forth direction is accomplished by sliding the holder 18 along the second longer side 32. When the two bolts 78 (see FIG. 8B) are loosened, the force to hold the second longer side 32 of the frame 12 can be adjusted. Therefore, the holder 18 is enabled to be slidable in the horizontal direction within the ranges of the elongated holes 77 in the frame 12. One end of the J-rod 10 inserted into the cylindrical portion 71 is turnably fixed to the carrier 8. For this reason, when the holder 18 is slid, the J-rod 10 turns right or left around one end of the carrier 8. This varies the distance between the player and the frame 12 to adjust the back-and-forth positions of the drums 2 through 7.

If, for instance, the right and left holders 18 are slid from the state shown in FIG. 1 to bring them closer to each other, the distance between the player and the frame 12 will increase. Therefore, the positions of the drums 2 through 7 are adjusted in the direction away from the player. After the adjustment of the back-and-forth positions, the bolt 78 should be tightened to fix the holding portion 18 against inadvertent sliding.

Next, the positional adjustment of the drums 2 through 7 in the lateral direction is accomplished by sliding the bracket 36 of the first adjusting mechanism 15 (or the second adjusting mechanism 16) along the elongated hole 47 in the base 35. Referring to FIG. 2, sliding the bracket 36 rightward would cause the elbow piece 34 to slightly turn counterclockwise around the shaft 46 and to move rightward as indicated by the two-dot chain lines in FIG. 1. Along with this, the rightmost larger-diameter drum 2 is adjusted rightward. When the bracket 36 is slid leftward, the drum 2 is adjusted leftward.

Here, the larger-diameter drum 3 (of the first drum pair 22) and the larger-diameter drum 4 (of the second drum pair 23) are turnably linked by the linking mechanism 17. Where the two drum pairs 22 and 23 are linked to be unable to turn relative to each other as in the conventional arrangement, the drum 4, interlocked with the drum 3, to be moved by the latter toward the player, is therefore apt to change its position. In this embodiment, however, as the two drums 3 and 4 are linked to be turnable, one of the drums is rarely affected by the motion of the other. As the two-dot chain lines in FIG. 1 showing the positions of the drums after adjustment indicate, their motions are kept to a minimum. Thus, the earlier adjusted positions of the larger-diameter drums 3 and 4 in the back-and-forth direction hardly vary during the positional adjustment in the right-and-left direction.

Further, in the conventional arrangement, sliding the holders would be accompanied by a corresponding variation in the distance between the player and the frame, resulting in a variation of the positional relationship between the drums and the player even in the back-and-forth direction. In this embodiment, however, the positional adjustment mechanism for the drums in the back-and-forth direction and that in the right-and-left direction are provided independent of each other, and such a problem cannot arise.

To elaborate, the position of the larger-diameter drum 5 at the left end in the lateral direction is also adjusted by sliding the bracket of the second adjusting mechanism 16 rightward or leftward. After the adjustment of the drum in the lateral direction, the nuts 46 in the first adjusting mechanism 15 and the second adjusting mechanism 16, the nut 51 and the nut 61 of the linking mechanism 17 are tightened to fix all the larger-diameter drums 2 through 5 to the frame 12.

Next, the positional adjustment of the smaller-diameter drums 6 and 7 in the back-and-forth direction is accomplished by loosening the screws 98 of the fitting mechanism 19 and sliding the movable piece 93 (see FIG. 11) within the slit 91 in the base 92 so as to bring it closer to or farther away from the player. This causes the positions of the smaller-diameter drums 6 and 7 connected to the movable piece 93 to be adjusted. Incidentally, after this positional adjustment, the screws 98 are tightened to fix the movable piece 93 against sliding.

The positional adjustment of the smaller-diameter drums 6 and 7 in the up-and-down direction is accomplished by loosening the screws 106 of the fitting mechanism 19 and sliding the connector 94 up or down (see FIG. 11) and the base 92 and the movable piece 93, both linked to the connector 94. Therefore, the positions of the smaller-diameter drums 6 and 7 in the up-and-down direction are adjusted. Incidentally, after the positional adjustment of the drums 6 and 7, the screws 106 are tightened to fix the connector 94.

The angles of the drums are adjusted by turning the bolts 74 (see FIG. 8A) of the holders 18. For instance, tightening the bolts 74 would cause their tips to thrust the frame 12 upward, and accordingly the drums are so adjusted in angle that portions closer to the player are inclined farther downward than elsewhere.

According to the invention, the larger-diameter drums forming the drum pairs 22 and 23 are fixed to be unable to turn relative to each other. Therefore, when the positions of the larger-diameter drums 2 through 5 are to be adjusted, only three mechanisms act. Accordingly, the larger-diameter drums 2 through 5 would not move indeterminately when their positions are adjusted in the right-and-left direction. This contributes to the stability of the frame 12 and facilitates positional adjustment of the drums. Moreover, the reduction in the number of movable mechanisms results in a smaller overall number of members, which contributes to reducing the weight of the whole device.

The first adjusting mechanism 15, the second adjusting mechanism 16 and the linking mechanism 17, which are all movable, can move the larger-diameter drums 2 through 5 smoothly during their positional adjustment because the drums (or the frame 12) are linked to be movable relative to each other.

The fitting mechanism 19 disposed on the second longer side of the frame 12 is provided with a mechanism for positional adjustment of the smaller-diameter drums 6 and 7 in the back-and-forth and up-and-down directions. For this reason, the positional adjustment of only the smaller-diameter drums 6 and 7 within the frame 12 can be accomplished in the back-and-forth and up-and-down directions independent of the larger-diameter drums 2 through 5.

The provision of the three legs 21 enables the drum set 1 to be stably arranged on the floor or the like when in transit or in storage. It is also possible to roughly adjust the positions of the drums in a state in which the drum set 1 is arranged on the floor. Moreover, the legs 21 are detachable. Therefore, it is possible to use the drum set with the legs removed, so that there is no possibility for the legs 21 to obstruct performance.

The present invention can also be implemented in the following mode.

Although the frame 12 in the foregoing embodiment is supposed to be formed in a rectangular shape, it is possible to dispense with the first longer side 31.

In the first adjusting mechanism 15, only one larger-diameter drum 2 is supported by the elbow piece 34. In this configuration, too, as the larger-diameter drum 2 and the larger-diameter drum 3 are fixed by the first fixing mechanism 13, the larger-diameter drum 3 can be interlocked with the larger-diameter drum 2.

The first fixing mechanism 13 and the second fixing mechanism 14 are dispensed with. Thus, as the elbow piece 34 in the linking mechanism 15 also functions as means of fixing the relative positions of the larger-diameter drum 2 and the larger-diameter drum 3, there can be no adverse effect on the operations of the drums 2 and 3.

Figure 13:
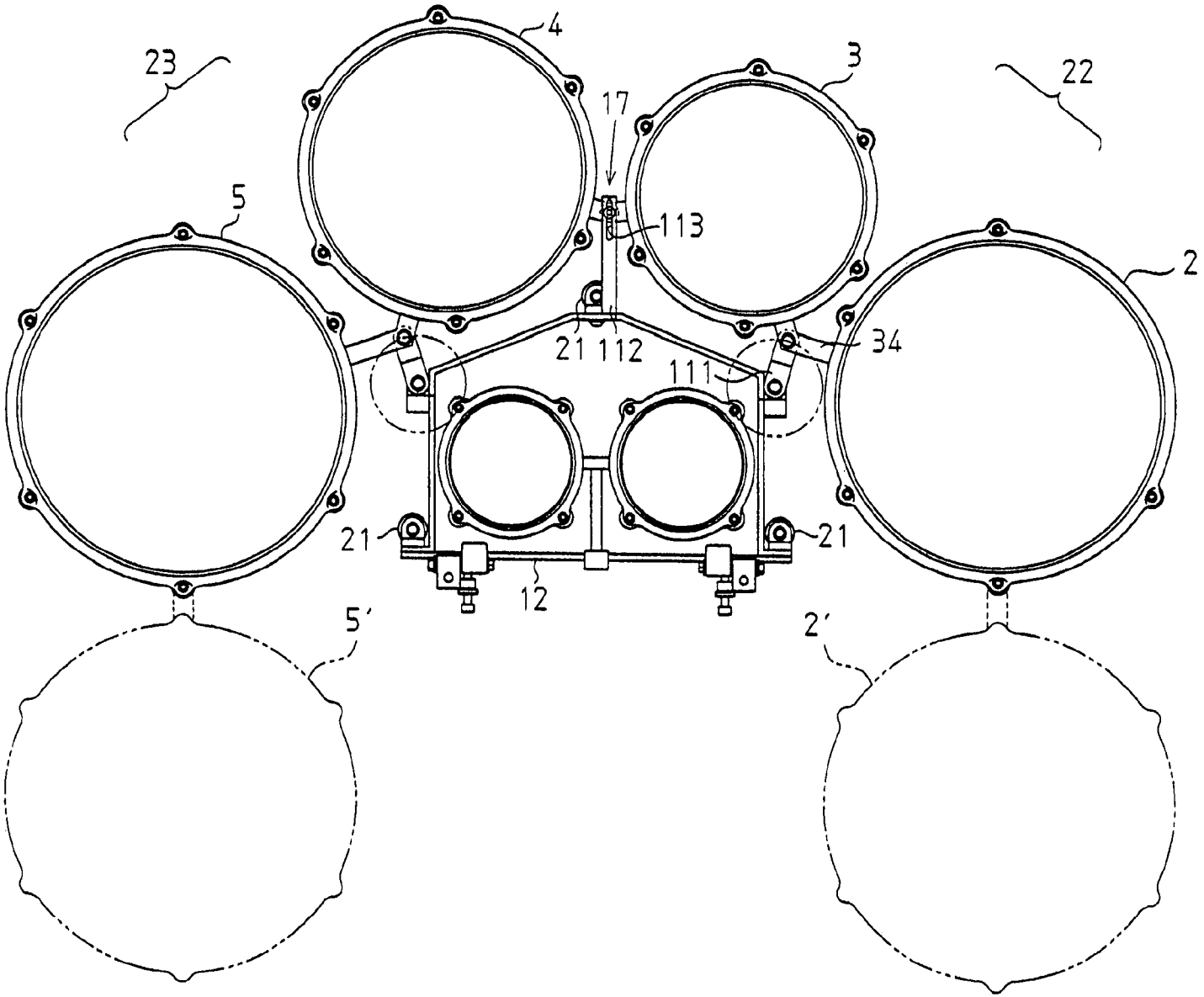
FIG. 13 is a plan view showing a support device for marching tenor drums according to another preferred embodiment of the invention.

As shown in FIG. 13, a link 111 turnably fitted to the frame 12 is used in place of the bracket 36 in an alternate embodiment in accordance with the invention. In this configuration, the link 111 turns and moves while turning the elbow piece 34, and accordingly the drum 2 moves rightward.

As also shown in FIG. 13, the linking mechanism 17 is fixed to the frame 12 to cause it to move linearly in the back-and-forth directions. More specifically, the linking mechanism 17 is positioned within a slit 113 in a plate 112 extending forward from the frame 12. In this case, in adjusting the left and right larger-diameter drums 2 and 5 in the lateral direction, the two larger-diameter drums 3 and in the center area 4 are prevented from deviating sideways. Therefore, the positions of the drums 3 and 4 in the lateral direction can be kept constant relative to the frame 12 all the time.

Furthermore, the stability of the supporting device against external forces is also increased. Moreover, the four turning portions to the right and left (the turnable portions at both ends of the link 111) can be turned without being shaky. Since this configuration requires no locking mechanism, screwable adjustment is done only in one central position, and the operation is therefore easy.

Furthermore in the embodiment shown in FIG. 13, the larger-diameter drum 3 and the larger-diameter drum 4 are fixed by the linking mechanism 17 to be unable to move relative to each other. The first adjusting mechanism 15 and the second adjusting mechanism 16 link, out of the larger-diameter drums 2 and 3 (or 4 and 5), the drum 2 or 5 to be able to turn independently. The first adjusting mechanism (or the second adjusting mechanism) is configured of the single link 111 for turnably linking the larger-diameter drums 2 and 5 to the frame 12, and the linking mechanism is fixed to the frame 12. In adjusting the positions of the left and right larger-diameter drums 2 and 5 in the lateral direction, the two central larger-diameter drums 3 and 4, as they are fixed to each other, cannot be displaced in the back-and-forth direction.

The positions of the legs 21 can be altered as appropriate. For instance, as shown in FIG. 13, they can as well be positioned at three points on the frame 12 in a well balanced way.

The legs 21 may be of another type instead of a screw arrangement. If they are not shaky when fitted and can be readily detached, any other appropriate configuration will be acceptable. For instance, in order to prevent shakiness, rubber cushions can be placed in the fitting positions of the legs 21.

The number of the smaller-diameter drums 6 and 7 may be only one. Even in this case, a single drum can be arranged by using the fitting mechanism 19 as shown in FIG. 14. In this arrangement, a cap 107 (indicated by a two-dot chain line in FIG. 14) can be placed in the drum-absent part of the connector 93. Furthermore, the number of larger-diameter drums 2 through 5 can also be altered as appropriate.

Figure 15:
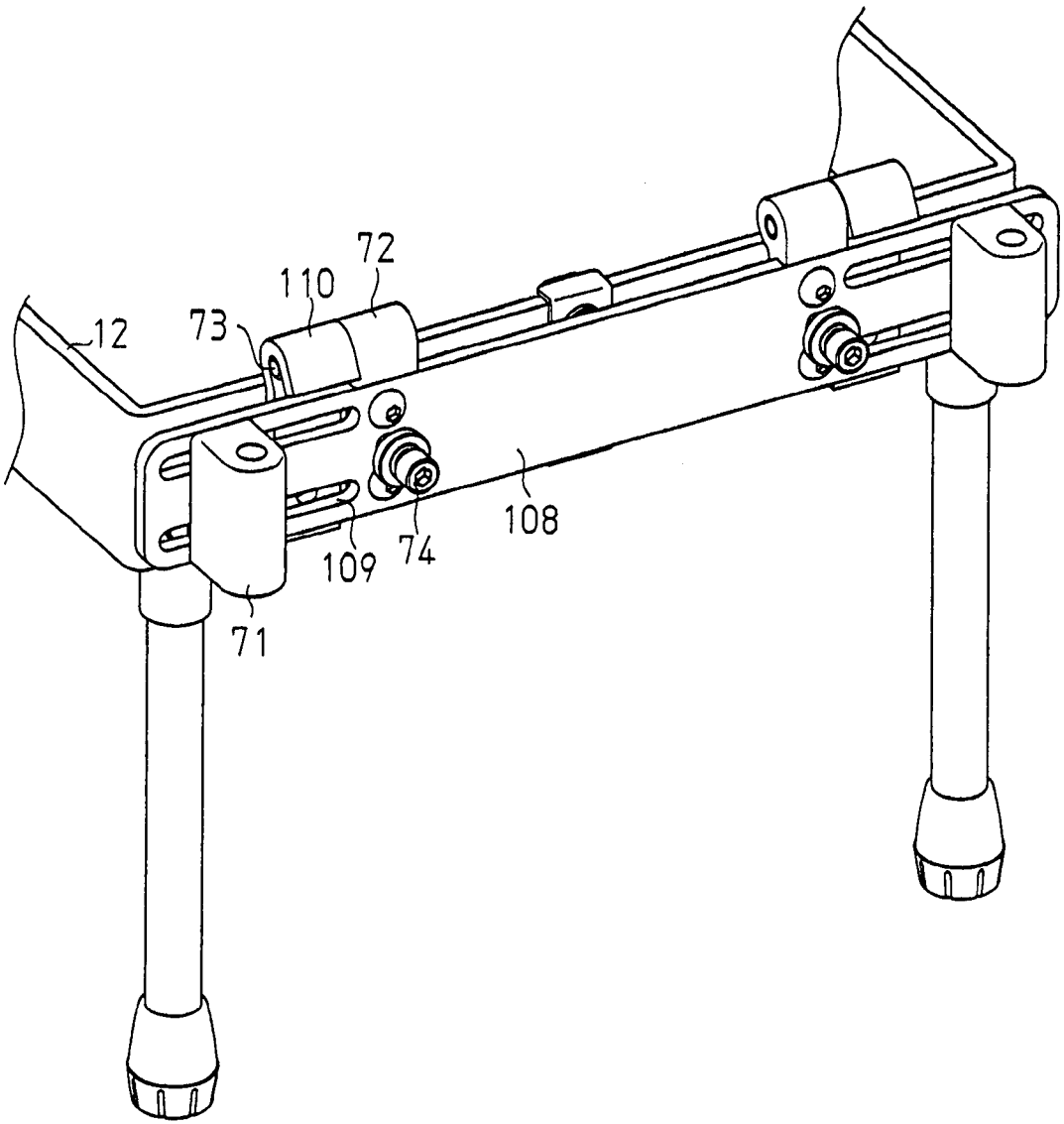
FIG. 15 shows a perspective view of a holding portion for the embodiment of FIG. 14.
Figure 16:
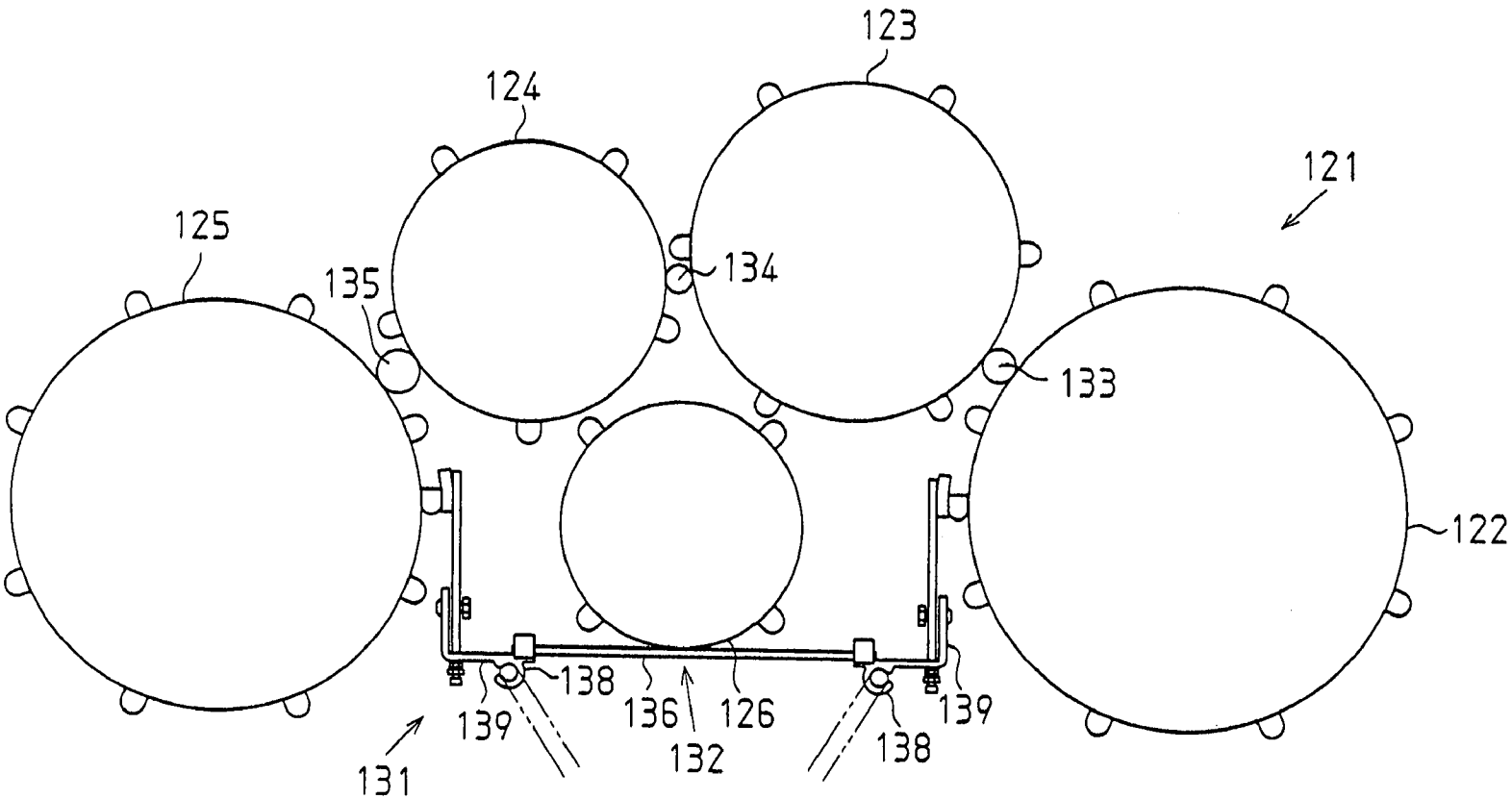
Fig. 16(Prior Art)
FIG. 16 is a schematic plan showing one example of a conventional support device for marching tenor drums.
Figure 17:
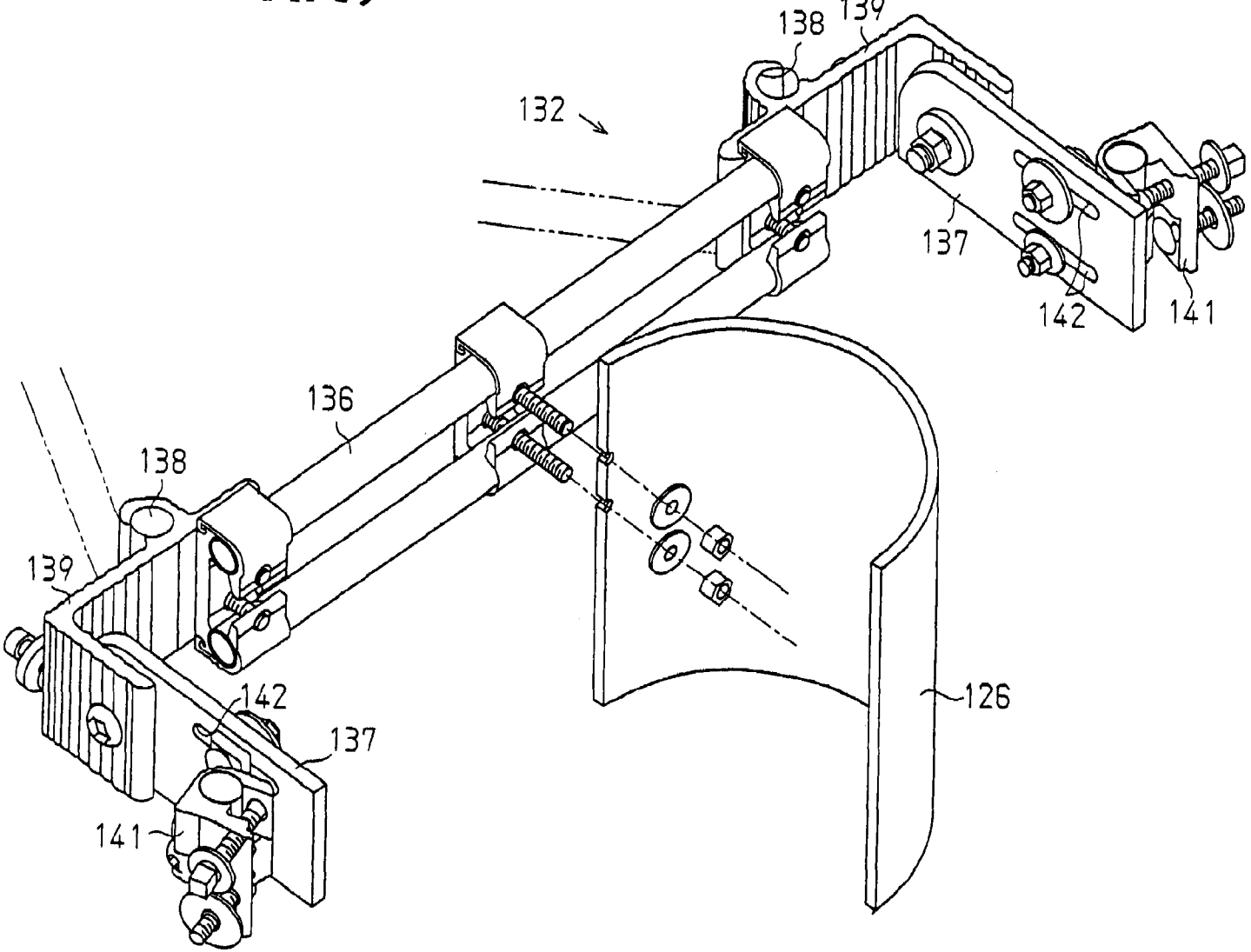
Fig. 17(Prior Art)
FIG. 17 shows a perspective view of the configuration of a frame, which is the principal component of the support device shown in FIG. 16.

In each of the holders 18, the cylindrical portion 71 and the connecting portion 72 may as well be separately configured. More specifically, a base plate 108 independent of the frame 12 is disposed as shown in FIG. 15. The cylindrical portion 71 is arranged to be slidable in the lateral direction along a slit 109 formed in this cylindrical portion base plate 108. Further, the connecting portion 72 having the rotation shaft 73 is fixed to the base plate 108, and a hook 110 disposed on the frame 12 is engaged with the rotation shaft 73 from above. This configuration enables the cylindrical portion 71 to be independently slidable.

In this other embodiment, the movement direction of the right and left cylindrical portions 71 is limited to the lateral direction. Accordingly, there will be no deviation of the cylindrical portions 71 in the right-and-left direction, with the result that the J-rod 10 of the carrier 8 can be readily linked to the cylindrical portions 71.

Furthermore, a player can first link to the J-rod 10 a mechanism configured of the cylindrical portions 71, the plate 108 and the connecting portion 72, and fit the drum set 1 by engaging the hook 100 on the rotation shaft 73 from above. In other words, the procedure needs only the step of fitting the base plate 108 to the carrier 8 and that of fitting the frame 12 supporting the drums to the plate 108, and fitting is therefore much facilitated.

The sequence of positional adjustment of the drums can be altered as appropriate. For instance, rough positional adjustment in the back-and-forth and right-and-left directions can be accomplished in a state with the drums placed on the floor, followed by fitting of the drum set 1 supported by the support device 11 and fine adjustment procedures including the adjustment of angles. The positions of the drums can be adjusted in the back-and-forth direction after they are adjusted in the lateral direction.

The embodiments described herein are to be considered as illustrative and not restrictive and the invention is not to be limited to the details given herein, but may be modified within the scope and equivalence of the appended claims.

What is claimed is:

1. A support device for a set of marching tenor drums to be carried on the body of a player, comprising:

at least four drums arrayed in an arc-shaped configuration and comprising a first group of two or three consecutive drums and a second group including the rest of the drums;

a frame;

a holding mechanism for maintaining the drums in each group in fixed positions relative to each other, the holding mechanism comprising a fixing member extending between two adjacent drums of the same group and non-pivotally affixing the two adjacent drums to each other;

a pair of first adjusting mechanisms for respectively adjusting positions of the first and second groups with reference to the player, each of the first adjusting mechanisms comprising an adjuster slidably mounted on the frame and connected to the fixing member of one of the groups, wherein adjusting a position of the adjuster with respect to the frame adjusts a position of an associated group of drums through a displacement of the fixing member; and a linking mechanism for linking the first and second groups together, the linking mechanism being operable to permit relative rotation of the first and second groups to compensate for differences in the amounts of adjustment of the first adjusting mechanisms.

2. The support device according to claim 1, wherein each drum includes a barrel forming a body of each drum, and the holding mechanism non-pivotally affixes the barrels of adjoining drums in each group to one another.

3. The support device according to claim 1, wherein the frame is surrounded by the configuration of the drums, the frame being channel-shaped or rectangularly shaped.

4. The support device according to claim 3, wherein said first adjusting mechanism is located outside a body of the frame, and wherein the drums in the first group rotate about the linking mechanism when the first adjusting mechanism is manipulated.

5. The support device according to claim 4, further comprising a second adjusting mechanism disposed on said frame and manipulated outside the frame to bring said drums toward or away from the player.

6. The support device according to claim 5 further comprising a third adjusting mechanism effective to adjust the angles of orientation of said drums.

7. The support device according to claim 6, wherein said third adjusting mechanism includes adjusting members respectively corresponding to the drums, and wherein the angles of orientation of all drums are simultaneously adjusted when the adjusting members are simultaneously manipulated.

8. The support device according to claim 1, having a leg for contacting a floor surface.

9. The support device according to claim 8, wherein said leg is detachably connected to the support device.

10. The support device according to claim 1, having three legs for contacting a floor surface.

11. The support device according to claim 1, wherein two drums adjoining each other at each end of the array of four drums form a first group and a second group, and the first group and second group are rotatably linked by said linking mechanism.

12. A support device for a set of marching tenor drums, comprising:

four marching tenor drums positioned in an arc-shaped array and adapted to be carried on the body of a player, wherein two adjacent drums at each end of the array form a respective first group and second group, and wherein each drum includes a barrel forming a body of the drum;

a frame;

a holding mechanism for maintaining the drums in each respective groups in fixed positions relative to each other, the holding mechanism of each group comprising a fixing member extending between barrels of two adjacent drums of each group and non-pivotally affixing the barrels of the two adjacent drums of each group to each other;

a pair of first adjusting mechanisms for respectively adjusting positions of the first and second groups with reference to the player, each of the first adjusting mechanisms comprising an adjuster slidably mounted on the frame and connected to the fixing member of one of the groups, wherein adjusting a position of the adjuster with respect to the frame adjusts a position of an associated group of drums through a displacement of the fixing member; and a linking mechanism for linking the first group and the second groups, the linking mechanism being operable to permit relative rotation of the first and second groups to compensate for differences in the amounts of adjustment of the first adjusting mechanisms.

13. The support device according to claim 12, wherein the frame is channel-shaped or rectangularly shaped and is surrounded by the array of the drums.

14. The support device according to claim 13, further comprising:

a carrier effective to fit to the body of the player;

J-rods each extending downward from said carrier, each said J-rod having an end rotatably coupled to the carrier; and a second adjusting mechanism disposed on said frame to bear the J-rod that rotates the carrier so as to bring said drums toward or away from the player.

15. The support device according to claim 14, further comprising a third adjusting mechanism effective to adjust the angles of orientation of said drums.

16. A set of marching tenor drums including a support device according to claim 15, and further including a first drum different from the drums of the first group and the second group, which is positioned within said frame.

17. The drum set according to claim 16, further including a second drum within the frame which is different from the drums in the first group and the second group, wherein a vertical position of the first and second different drums is adjustable independently from that of the drums in the first group and the second group.

18. The drum set according to claim 16, further including a second drum within the frame which is different from the drums in the first group and the second group, wherein the distance of the first and second different drums from the player is adjustable independently of the distance of the drums in the first group and the second group from the player.

19. The support device according to claim 12, having at least three legs detachably fitted to the support device which are configured and positioned to make contact with a floor surface.

* * * * *